US006014154A

United States Patent [19]

Guerin

[11] Patent Number: 6,014,154

[45] Date of Patent: Jan. 11, 2000

[54] IMAGE SELF-REGISTRATION FOR COLOR PRINTER

[75] Inventor: Jean-Michel Guerin, Glendale, Calif.

[73] Assignee: Xerox Corporation, Stamford, Conn.

[21] Appl. No.: 08/716,963

[22] Filed: Sep. 20, 1996

[51] Int. Cl.[7] ..... B41J 2/385

[52] U.S. Cl. ..... 347/116; 347/129; 347/139

[58] Field of Search ..... 347/116, 118, 347/129, 139, 115; 399/145, 165, 395, 49, 71, 40, 41, 232, 264, 296; 355/89

[56] References Cited

U.S. PATENT DOCUMENTS 5,444,469 8/1995 Cowger ..... 347/14

*Primary Examiner*—John Barlow
*Assistant Examiner*—Raquel Yvette Gordon

[57] ABSTRACT

There is disclosed a color xerographic printing system which utilizes one full length developer to develop a first latent image and registration marks on the margins along the first latent image. The color printing system of this invention, also utilizes a second developer which only covers the second latent image created over the first latent image to prevent the developed registration marks from attracting more toner.

4 Claims, 6 Drawing Sheets

IMAGE SELF-REGISTRATION FOR COLOR PRINTER

BACKGROUND OF THE INVENTION

This invention relates to a process of registration in a color xerographic printing system, and more particularly, to a self registration process in a Discharge Area Develop (DAD) system which utilizes a marking system for monitoring the toner placement of the first latent image for precise placement of toner on the subsequent latent images. It should be noted that hereinafter, for the purpose of simplicity, the "color xerographic printing system" is referred to as "color printing system".

Referring to FIG. 1, a color printing system 10 comprises a photoreceptor 12, and four color stations. However, for the purpose of simplicity, only two stations $A_1$ and $A_2$ are shown. Each color station, which is dedicated to a single color, comprises a charger 14, a raster output scanner (ROS) 16 and a developer 18. A charger is a device which charges the photoreceptor evenly prior to scanning, a ROS is a system which generates a latent image and a developer is a device which holds toner and deposits toner onto the latent image.

Referring to FIG. 2, there is shown a tangential (fast-scan) view of the raster output scanner 16 of the printing system 10 of FIG. 1. The raster scanning system 16 utilizes a laser light source 20, a collimator 22, pre-polygon optics 24, a multi-faceted rotating polygon mirror 26 as the scanning element, post polygon optics 28 and a photosensitive medium 30.

The laser light source 20 sends a light beam 32 to the rotating polygon mirror 26 through the collimator 22 and the pre-polygon optics 24. The collimator 22 collimates the light beam 32 and the pre-polygon optics 24 focuses the light beam 32 in the sagittal or cross-scan plane onto the rotating polygon mirror 28. The facets 34 of the rotating polygon mirror 26 reflect the light beam 32 and also cause the reflected light beam 32 to revolve about an axis near the reflection point of the facet 34. The reflected light beam 32 is utilized through the post polygon optics 28 to scan a photosensitive medium 30, such as a xerographic drum (photoreceptor). Referring to FIG. 3, since the photoreceptor 30 moves, the light beam 32 scans all the scan lines 36 of a document on the photoreceptor and generates a latent image.

Typically, in a color printing system, a latent image is being generated for each basic color and each latent image is being placed over the previous latent images. Referring to both FIGS. 1 and 3, each one of the color stations $A_1$ and $A_2$ generates one of the latent images. In the ROS 16 of each color station, the scanning light beam is modulated by the information of a given color. The scanning light beam 32 scans the photoreceptor 30 and discharges the photoreceptor according to the information of the given color to generate a latent image for the given color. While a latent image is being generated, the portion that is discharged will move under the developer 18 to be developed. Developing is defined as the latent image attracting toner from a toner station.

As the first latent image is being developed, the developed portion of the first latent image gradually moves into color station $A_2$. In this ROS 16 of the color station $A_2$, the light beam will be modulated by the information of a different color. The modulated light beam will start generating a new latent image over the first latent image.

In this manner each one of the following stations generates and develops a latent image over the previous latent images. The process of generating and developing a latent image is repeated four times, each by one of the stations, for four different colors (typically, cyan, yellow magenta and black). After the four different color toners are placed over each other, the toners will be transferred onto a sheet of paper.

Since each latent image is being generated over the previous latent image, the placement of each latent image is very critical. However, due to several factors such as the photoreceptor motion variation, vibration, thermal expansion, etc., the location of the scan lines of the latent images following the first latent image might be slightly different compared to the position of the scan lines of first latent image. Slight variation of the location of the scan lines causes the pixels of the same scan line of each latent image to be placed at different locations. This causes a problem known as mis-regiteration.

Referring to FIG. 4, one approach to match the scan lines of each latent image with the same scan lines of the first latent image is to place registration marks 40 and 42 on the margins 44 and 46 of each scan line, on the first latent image. Referring back to FIG. 1, the registration marks 40 and 42 will be developed as the first latent image is being developed. During the generation of the following latent images, the developed registration marks 40 and 42 of the developed first latent image (primary image 45) will be checked to determine if the current scan line is offset compared to the same scan line of the first latent image.

Checking or reading the registration marks can be achieved through different means such as CCD cameras, pattern recognition software and slit detectors.

When the scanning light beam is used to read the developed registration marks, the reflection of the light beam from the photoreceptor will be used. Referring to FIG. 5, the photoreceptor 30 reflects the light beam 32 (shown by solid line) where it does not have toner and absorbs the light beam 32' (shown by dashed line) where it has toner 43. This concept is used to read the registration marks. Two sensors 50 and 52 are placed over the photoreceptor on each margin 44 and 46 respectively to detect where the light beam is not reflected back (such as developed registration mark 43) to identify the developed registration marks on the margins.

During the generation of the following latent images, the scanning light beam will read the developed registration marks to compare the position of the current scan line with the position of the same scan line of the primary image 45. This method is appropriate for Charged Area Develop (CAD) which is also referred to as write-white as disclosed in U.S. Pat. No. 5,255,154. However, in the Discharged Area Develop (DAD) printing system which is also referred to as write-black, this method is not appropriate.

In a raster scanning system using DAD printing system, when a light beam strikes the photoreceptor, it discharges the photoreceptor. As a result, once a light beam scans over the developed registration marks for the purpose of detecting them, it will again discharge the photoreceptor under the developed registration marks. Therefore, the developed registration marks will attract more toner during the time the current latent image is being developed. The attraction of more toners on the registration marks is undesirable since more toner causes the marks to become large and loose their accuracy.

It is an object of this invention to provide a method of generating and reading the developed registration marks by a scanning light beam in a DAD printing system without attracting extra toner on the developed registration marks during the generation of the following latent images.

SUMMARY OF THE INVENTION

In accordance with the present invention, there is disclosed a color xerographic printing system with a discharge area develop (DAD) system which utilizes a scanning light beam to read the developed registration marks which are placed on the margins of a first latent image. The scanning light beam while generating the second latent image over the first developed latent image (primary image) scans over the margins to read the developed registration marks. Since in a DAD system, the discharged areas will be developed, once the light beam reads the developed registration marks, it will discharge the area under the developed registration marks again. In addition to a first developer which is long enough to cover the first latent image and the margins, the printing system of this invention utilizes a second developer to only cover the second latent image to prevent the developed registration marks from attracting more toner.

DETAILED DESCRIPTION OF THE INVENTION

Figure 1:
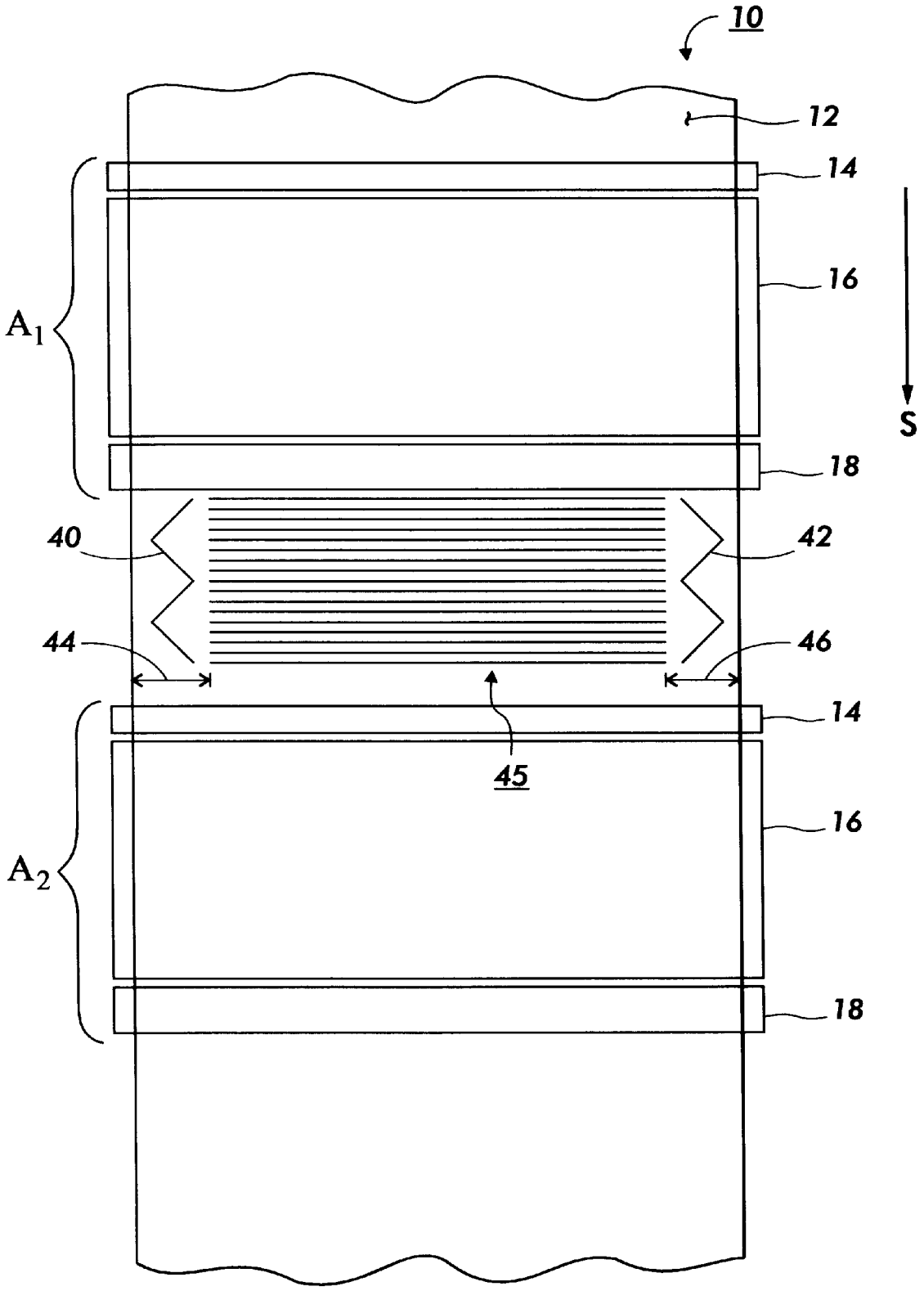
FIG. 1 PRIOR ART
FIG. 1 shows a prior art color printing system.
Figure 2:
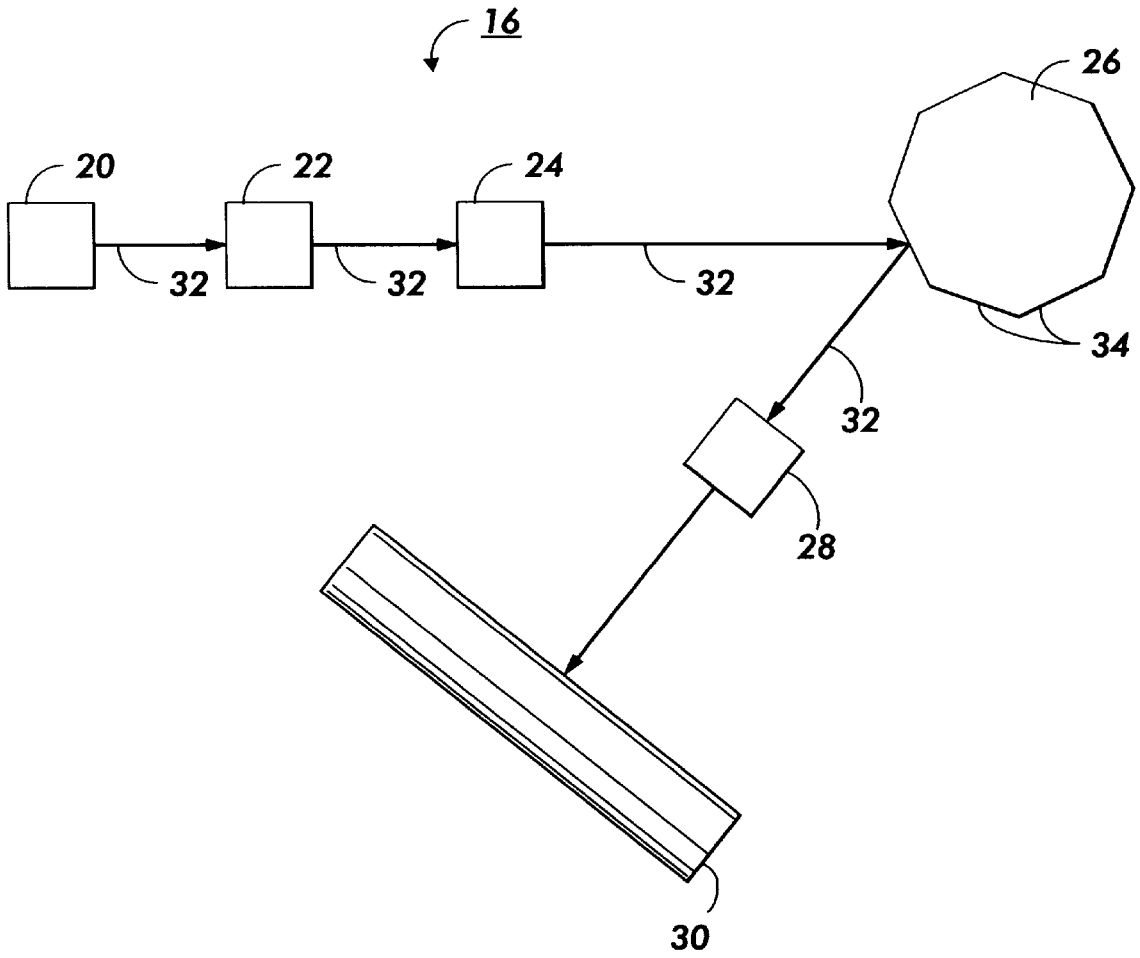
FIG. 2 PRIOR ART
FIG. 2 shows a tangential (fast-scan) view of the raster output scanner of the printing system of FIG. 1.
Figure 3:
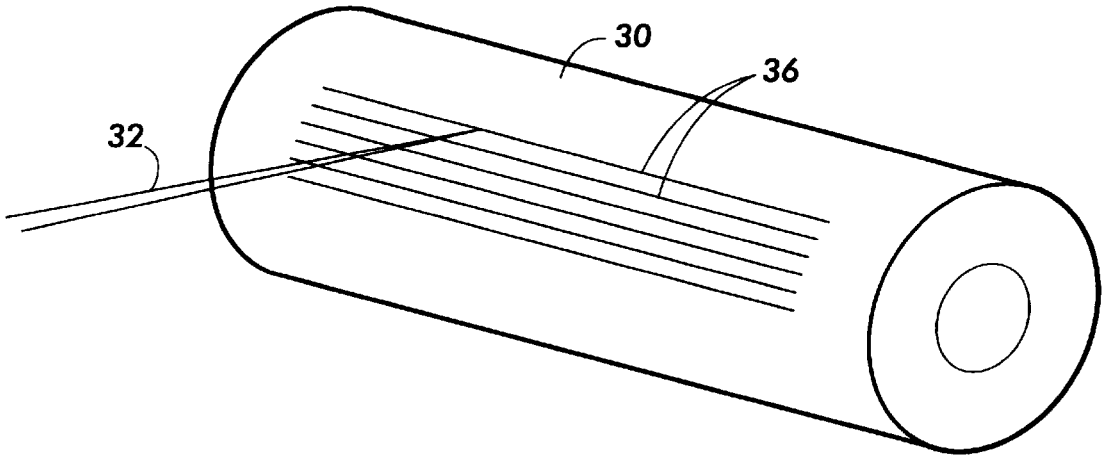
FIG. 3 PRIOR ART
FIG. 3 shows a light beam scanning the scan lines of a latent image in a prior art system.
Figure 4:
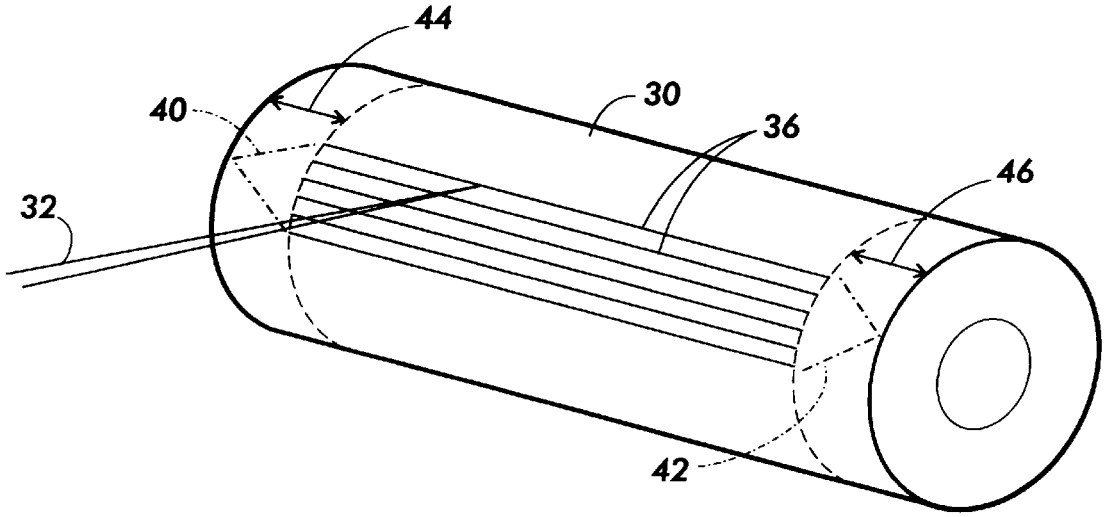
FIG. 4 PRIOR ART
FIG. 4 shows a light beam scanning a latent image and placing registration marks on the margins in a prior art system.
Figure 5:
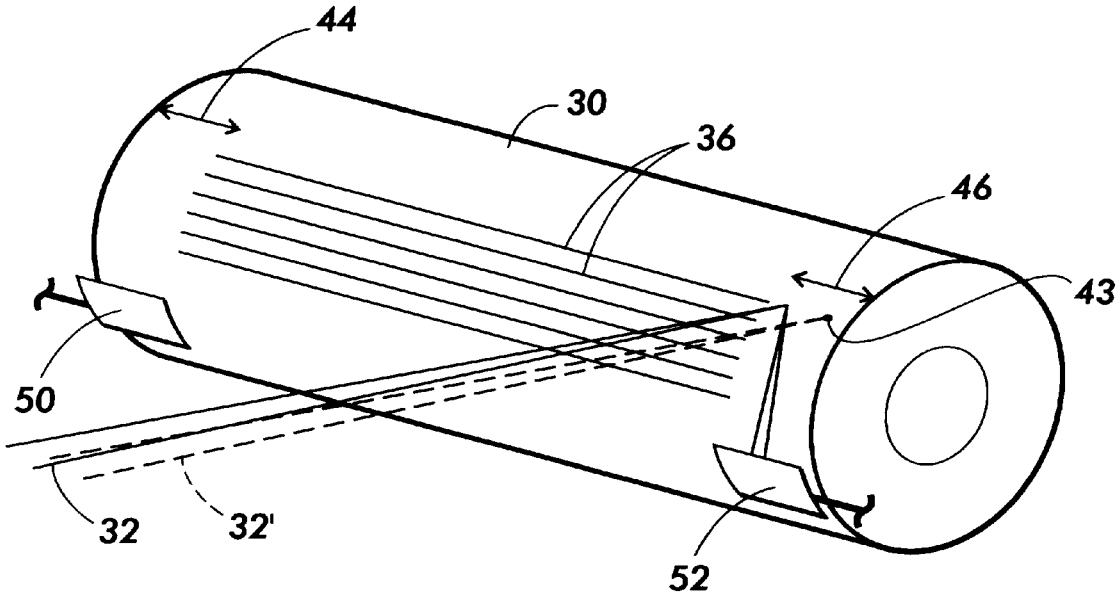
FIG. 5 PRIOR ART
FIG. 5 shows a photoreceptor which reflects the scanning light beam where it does not have toner and absorbs the scanning light beam where it has toner in a prior art system.
Figure 6:
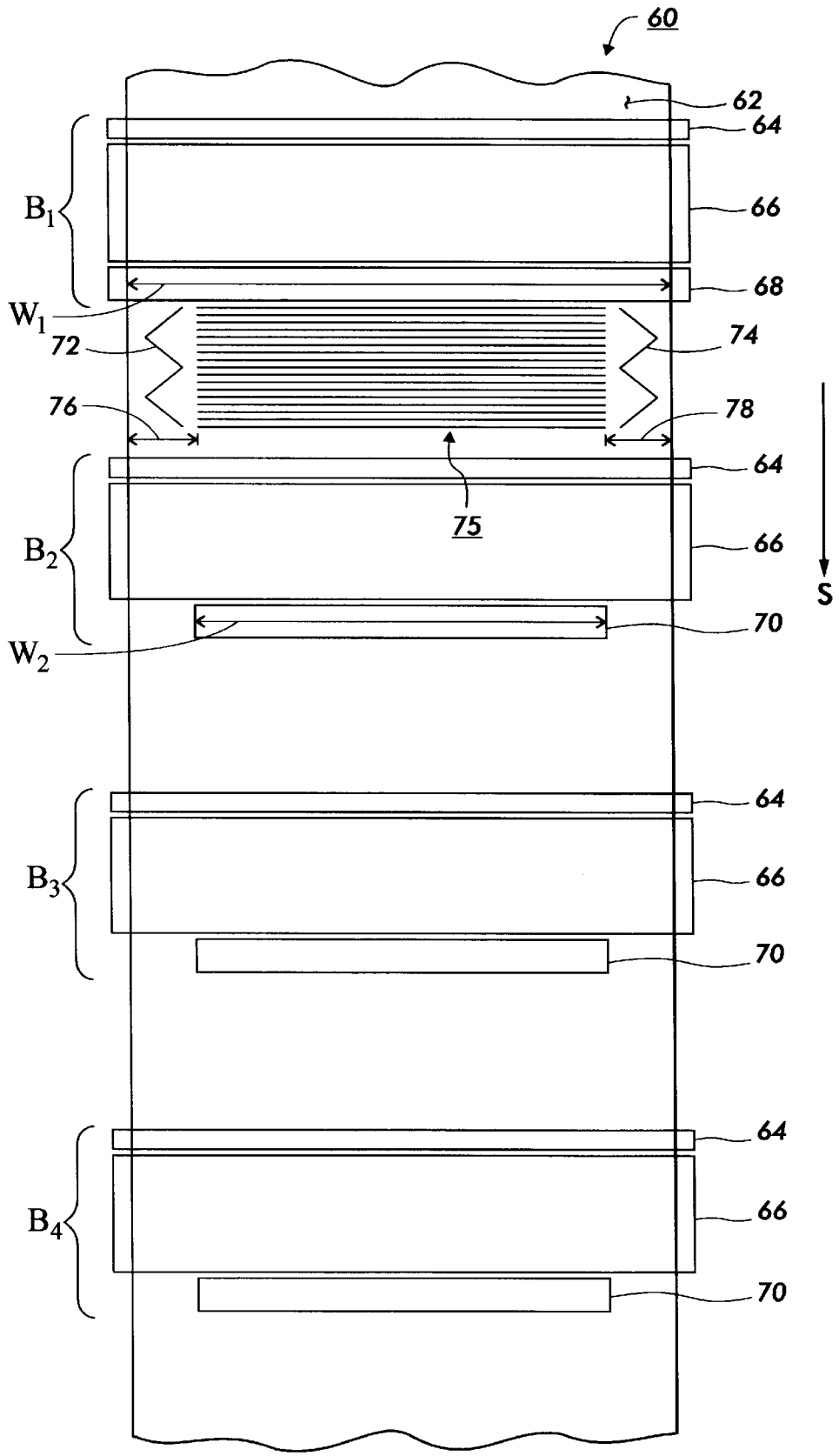
FIG. 6 shows a single pass color printing system of this invention.

Referring to FIG. 6, there is shown a printing system 60 of this invention. The printing system 60 comprises a photoreceptor 62 and four color stations $B_1$, $B_2$, $B_3$ and $B_4$. For the purpose of clarity, the photoreceptor 62 is unrolled and is shown as a flat belt 62. Each one of the color stations $B_1$, $B_2$, $B_3$ and $B_4$ comprises a full length charger 64 and a full length ROS 66. It should be noted that in this specification, "full length" shall mean "a length which covers the full width $W_1$ of the photoreceptor 62". Color station $B_1$ has a full length developer 68. However, each one of the color stations $B_2$, $B_3$ and $B_4$ has a short length developer 70. It should be noted that in this specification, "short length" shall mean "a length which covers only the width $W_2$ of the latent image". The printing system 60 which is a DAD printing system moves in the direction shown as S.

In operation, in the station $B_{12}$, the charger 64 uniformly charges the photoreceptor 62 prior to the generation of the first latent image. Subsequently, a scanning light beam starts generating the first latent image by scanning the scan lines of the first latent image. In order to align the first latent image with the following latent images, the light beam will place registration marks 72 and 74 on each scan line on the side margins 76 and 78 of the first latent image. For placing the marks 72 and 74, the light beam will discharge the photoreceptor 62 in the margin 76 and 78 with a given pattern. In the preferred embodiment of this invention, chevron patterns are used for the registration marks 72 and 74. However, any pattern that could be used to match the scan lines of different latent images can replace the chevron patterns of this invention.

As the first latent image is being developed, since the developer 68 is a full length developer, toner will be deposited on the latent image and the registration marks 72 and 74. The developed registration marks 72 and 74 will be used to align the following latent images with the first latent image.

As the first developed latent image (primary image 75) leaves the developer 68 of the station $B_1$, it moves into the station $B_2$. In the station $B_2$, the full length charger 64 uniformly charges the photoreceptor under the primary image 75 and the developed registration marks 72 and 74. Then the primary image 75 moves under the ROS of station $B_2$ where a light beam starts scanning the second latent image over the primary image 75. The scanning light beam of the ROS 66 of the station $B_2$ will scan over the developed registration marks 72 and 74 at the start and at the end of each scan line for the purpose of reading the developed registration marks 72 and 74 in order to align each scan line of the second latent image with a respective scan line of the primary image 75.

As the second latent image is being generated, the generated portion moves under the developer 70 of the station $B_2$. Since the developer 70 is a short length developer, it only covers the width $W_2$ of the second latent image. As a result, the developed registration marks 72 and 74 do not receive any toner deposit since they are located outside of the boundary of the developer 70.

In the same manner, the following stations $B_3$ and $B_4$ have a short length developer which only cover the width $W_2$ of the third and fourth latent images. The DAD printing system 60 of FIG. 6 generates and reads the developed registration marks by a scanning light beam without attracting extra toner on the registration marks during the generation of the following latent images.

It should be noted that the disclosed embodiment of this invention is described based on a single pass printing system. In a single pass printing system, since there are four stations, a paper has to go through the printing system only once. However, the disclosed embodiment of this invention can also be utilized in a multi-pass system in which, there is only one station responsible for generating four latent images. In a multi-pass printing system, a sheet of paper has to pass through the same station four times.

Figure 7:
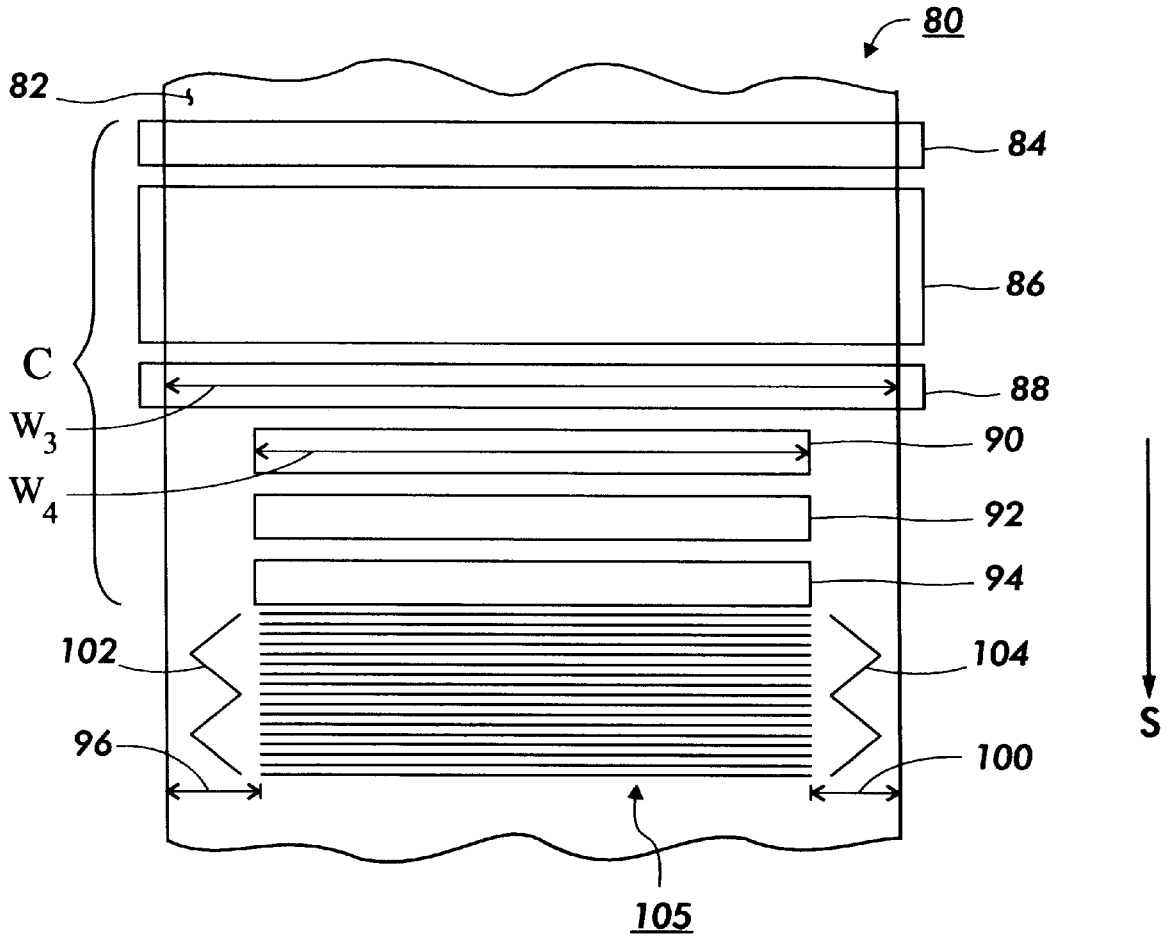
FIG. 7 shows a multi-pass color printing system of this invention.

Referring to FIG. 7, there is shown a multi-pass color printing system 80 of this invention. The printing system 80 comprises a photoreceptor 82 and one color stations C. For the purpose of clarity, the photoreceptor 82 is unrolled and is shown as a flat belt 82. The printing system 80 which is a DAD printing system moves in the direction shown as S.

The color station C has a full length charger 84, a full length ROS 86, a full length developer 88 and three short developers 90, 92 and 94. In the printing system 80, the first latent image and the registration marks will be developed by ROS 86. The first latent image and the registration marks will be developed by the developer 88, which has width $W_3$ to create the primary image 105 and the developed registration marks 102 and 104.

The photoreceptor 82 rotates once and the primary image 105 and the registration marks enter the color station C one more time. On the second pass, the ROS 86 generates a second latent image over the primary image 105 and at the same time reads the developed registration marks 102 and

104. On the second pass the developer 90, which is a short developer with width $W_4$, develops the second latent image. Since the developer 90 is a short developer, the developed registration marks do not attract more toner.

In the same manner, the photoreceptor 82 rotates two more times and the ROS 86 creates a third and a fourth latent image. The third latent image will be developed by the short developer 92 and the fourth latent image will be developed by the short developer 94. As a result, registration marks will be developed only once by the developer 88.

It should be noted that numerous changes in details of construction and the combination and arrangement of elements and materials may be resorted to without departing from the true spirit and scope of the invention as hereinafter claimed.

I claim:

1. A color xerographic printing system comprising:

a rotating medium having a primary image area and a registration marking area;

said primary image area being located adjacent to said registration marking area;

said primary image area having a first width and said registration marking area having a second width;

means for charging said primary image area and said registration marking area;

a scanning light beam scanning across said medium;

said scanning light beam, when on, being of an intensity to discharge the charge on said primary image area and said registration marking area;

said scanning light beam selectively discharging said registration marking area and said primary image area and creating discharged portions while leaving some charged portions intact to form a first latent image in each of said primary image area and said registration marking area;

a first developer having a length covering both said first width and said second width;

said first developer developing said first latent image in each of said primary image area and said registration marking area;

during a subsequent rotation of said medium, said charging means further charging said medium under said developed latent image in said primary image area and said registration marking area;

during the subsequent rotation of said medium, said scanning light beam further scanning over said developed latent image in said primary image area and said registration marking area to selectively discharge said primary image area and said registration marking area and create discharged portions while leaving some charged portions intact to form a second latent image over said developed latent image in said primary image area and said registration marking area and to read said developed latent image in said registration marking area;

a second developer having a length covering only said first width; and during the subsequent rotation of said medium, said second developer developing said second latent image only in said primary image area.

2. The color xerographic printing system recited in claim 1, wherein said registration marking area has two areas in such a manner that said primary image area is located between said two registration marking areas.

3. A color xerographic printing system comprising:

a medium having a primary image area and a registration marking area;

said primary image area being located adjacent to said registration marking area;

said primary image area having a first width and said registration marking area having a second width;

a first charging means for charging said primary image area and said registration marking area;

a first scanning light beam scanning across said medium;

said first scanning light beam, when on, being of an intensity to discharge the charge on said primary image area and said registration marking area;

said first scanning light beam selectively discharging said registration marking area and said primary image area and creating discharged portions and leaving some charged portions intact to form a first latent image in each of said primary image area and said registration marking area;

a first developer having a length covering both said first width and said second width;

said first developer developing said first latent image in each of said primary image area and said registration marking area;

a second charging means for charging said medium under said developed latent image in said primary image area and said first registration marking area;

a second scanning light beam scanning across said medium;

said second scanning light beam, when on, being of an intensity to discharge the charge on said primary image area and said registration marking area;

said second scanning light beam scanning over said developed first latent image in said primary image area and said registration marking area to selectively discharge said primary image area and said registration marking area while leaving some charged portions intact to form a second latent image over said developed latent image in said primary image area and said registration marking area and to read said developed latent image in said registration marking area; and a second developer having a length covering only said first width for developing said second latent image in said primary image area.

4. The color xerographic printing system recited in claim 3, wherein said registration marking area has two areas in such a manner that said primary image area is located between said two registration marking areas.

* * * * *